US006959533B2

(12) United States Patent
Noel, Jr. et al.

(10) Patent No.: US 6,959,533 B2
(45) Date of Patent: Nov. 1, 2005

(54) APPARATUS AND METHOD FOR PRODUCING TWISTED PAIR CABLES WITH REDUCED PROPAGATION DELAY AND CROSSTALK

(75) Inventors: Franc Edward Noel, Jr., Durham, NC (US); Daniel E. McConnell, Raleigh, NC (US); Thomas Toher, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 220 days.

(21) Appl. No.: 10/045,251

(22) Filed: Jan. 10, 2002

(65) Prior Publication Data

US 2003/0126851 A1 Jul. 10, 2003

(51) Int. Cl.[7] ..... D01H 7/02
(52) U.S. Cl. ..... 57/62; 57/67
(58) Field of Search ..... 57/59, 62, 63, 57/64, 200, 204, 206, 236, 237, 264, 283, 293; 174/34

(56) References Cited

U.S. PATENT DOCUMENTS

| | | | | | |
|---|---|---|---|---|---|
| 1,475,139 | A | | 11/1923 | Pearson | |
| 3,025,656 | A | * | 3/1962 | Cook | 57/293 |
| 3,052,079 | A | * | 9/1962 | Henning | 57/293 |
| 3,847,190 | A | | 11/1974 | Forester | 140/149 |
| 3,921,381 | A | | 11/1975 | Vogelsberg | 57/156 |
| 4,102,117 | A | * | 7/1978 | Dornberger | 57/93 |
| 4,408,443 | A | | 10/1983 | Brown et al. | 57/204 |
| 5,263,309 | A | * | 11/1993 | Campbell et al. | 57/264 |
| 5,535,579 | A | * | 7/1996 | Berry et al. | 57/13 |
| 5,574,250 | A | | 11/1996 | Hardie et al. | 174/36 |
| 5,706,642 | A | * | 1/1998 | Haselwander | 57/264 |
| 5,814,768 | A | | 9/1998 | Wessels et al. | 174/110 |
| 5,821,466 | A | | 10/1998 | Clark et al. | 174/113 |
| 5,939,952 | A | | 8/1999 | Noda et al. | 333/1 |
| 6,254,924 | B1 | | 7/2001 | Brorein et al. | 427/117 |
| 6,318,062 | B1 | * | 11/2001 | Doherty | 57/58.65 |
| 6,378,283 | B1 | * | 4/2002 | Barton | 57/58.52 |

FOREIGN PATENT DOCUMENTS

| | | | | |
|---|---|---|---|---|
| JP | 06349344 A | * | 12/1994 | H01B/11/04 |

* cited by examiner

*Primary Examiner*—John J. Calvert
*Assistant Examiner*—Shaun R Hurley
(74) *Attorney, Agent, or Firm*—Perman & Green, LLP; Casimer Salys (IBM)

(57) ABSTRACT

An apparatus for forming a twisted pair cable comprising a device for rotating at a first predetermined rate of rotation a pair of elongated conductor strands about a twisting location, the device guiding the elongated conductor strands to the twisting location. The strands, after leaving the twisting location, enter a twist stop device mounted adjacent the twisting location and the twist stop device grips running lengths of elongated conductor strands passing through the device for rotating and the twisting location. A strand puller engages the running lengths of elongated conductor strands after passing through the twist stop and advances the strands passing through the device for rotating, the twist stop device, the strand puller at a second predetermined rate of rotation. The device for rotation and the strand puller operating independently to make twisted pair cable having different twist rates on different segments, the segments having different lengths.

9 Claims, 5 Drawing Sheets

APPARATUS AND METHOD FOR PRODUCING TWISTED PAIR CABLES WITH REDUCED PROPAGATION DELAY AND CROSSTALK

CROSS-REFERENCE TO RELATED APPLICATIONS

The present invention is related to co-pending patent application Ser. No. 09/551,708, filed on Apr. 18, 2000, the disclosure of which is incorporated herein in its entirety.

BACKGROUND OF THE INVENTION

1. Field of the Invention

The present invention relates to paired electrical conductors in cables used for transmitting both digital and analog signals and, more particularly, to twisted pair cables.

2. Brief Description of Related Developments

It has been the practice for many years that signals being communicated electrically in communication networks be transmitted over twisted pairs of signal conductors. This has been true for telephony signals and other types of signals, both analog and digital, including signals passed in computer networks and sometimes within the computer assemblies.

The reasons that twisted pairs of signal conductors are used include controlling crosstalk between signal paths provided by various pairs which pass in close proximity to one another, such as being cabled together. In multi-pair cabling, two primary approaches have been used to control crosstalk. One is to have each pair in the cable twisted at a different twist rate (that is, the numbers of twists or turns per increment of length—a pair may be described as twisted at five turns per foot, for example). Another is to wrap each pair in a foil shield. Either approach imposes difficulties in manufacture, which conventional practice has come to accept.

Differing twist rates in twisted pairs which are cabled together, while effective in some control of crosstalk, presents other difficulties as signal rates through such pairs are increased. In particular, twisting pairs at different twist rates results in pairs which have differing physical lengths within a given length of cable thus resulting in differing signal propagation delay characteristics. For demanding applications such as 1–10 Gbps Ethernet, such differing physical lengths are a significant impediment as it is desirable to have as close as possible to simultaneous delivery of the transmissions on all pairs in a cable. Thus the capabilities of conventional twisted pair cables become marginal or unacceptable.

Thus, there exists a need to provide a cable having twisted pairs therein with different twist rates changing continuously over the length of the cable and an apparatus to make such a cable.

SUMMARY OF THE INVENTION

In accordance with one embodiment, an apparatus for forming a twisted pair cable has a device for rotating at a first predetermined rate of rotation a pair of elongated conductor strands about a twisting location, the device guiding the elongated conductor strands to the twisting location. The strands, after leaving the twisting location, enter a twist stop device mounted adjacent the twisting location and the twist stop device grips the running lengths of elongated conductor strands passing through the device for rotating and the twisting location. A strand puller engages the running lengths of elongated conductor strands after passing through the twist stop and advances the strands passing through the device for rotating, and the twist stop device, the strand puller operating at a second predetermined rate of rotation. The device for rotation and the strand puller operate independently to make a twisted pair cable having different twist rates on different segments, the segments having different lengths.

In accordance with a further embodiment, an apparatus for manufacturing twisted pair cables comprises a rotating frame operatively associated with a stationary frame and revolving about a twisting location. A twisting drive operatively drives the rotating frame in revolutions about the twisting location. The rotating frame has conductor guides mounted thereon for directing running lengths of elongated conductor strands along predetermined paths to the twisting location. A twist stop device is mounted on the stationary frame adjacent the twisting location and grips the running lengths of elongated conductor strands passing through the guides and the twisting location to from a twisted pair. A puller drive is operatively connected to the strand puller and drives the strand puller to advance strands through the conductor guides, the twisting location, the twist stop device, and the strand puller. The apparatus forms the twisted pair cable by controlling the twisting drive and the puller drive, each operating at varying speeds relative to each other, to twist pairs of strands passing through the apparatus into twisted pairs of indeterminate length having adjacent lengthwise segments of different length, and a number of twists on each segment differing from the next segment.

In accordance with a further embodiment, a method of forming a variable twist rate twisted pair cable is provided comprising the steps of rotating a frame on which two conductor strand spools are mounted at a first predetermined rate to create a twisting relationship between two conductors being fed from each strand spool and through the rotating frame; feeding the two conductors through a twist stop device that fixes a relative placement of each conductor as the conductors are fed together from the rotating carriage and through the twist stop; and rotating a strand puller at a second predetermined rate to pull the two conductors from the rotating carriage, through the twist stop device and to collect the variable twist rate twisted pair cable formed.

In accordance with a still further embodiment, a twisted pair cable is provided comprising a first conductor and a second conductor twisted about one another over a plurality of lengthwise segments, the segment lengths being unequal and a twist rate on each segment being different. Further, adjacent, side-by-side, twisted pair cables formed by the method of the present invention have different twist rates in adjacent segments.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT(S)

Figure 1:
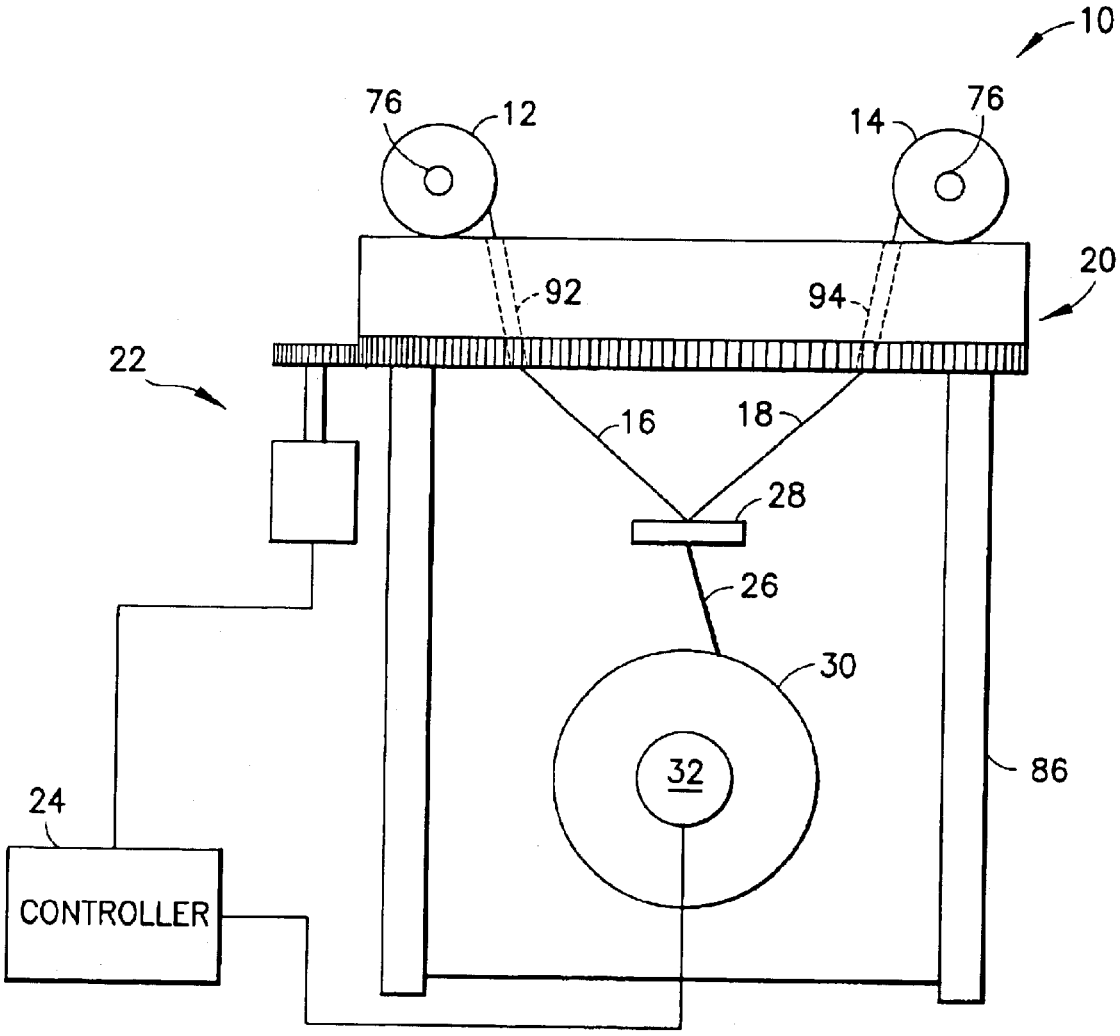
FIG. 1 is a block diagram of one embodiment of a system of the present invention.

Referring to FIG. 1, there is shown a block diagram of one embodiment of a system 10 incorporating features of the present invention. Although the present invention will be described with reference to the embodiment shown in the drawings, it should be understood that the present invention can be embodied in many alternate forms of embodiments. In addition, any suitable size, shape or type of elements or materials could be used.

The system 10 generally comprises an apparatus adapted to produce a variable twist rate twisted pair ("VTRTP") cable. In one embodiment, the system or apparatus can comprise a pair of strand spools 12, 14 where each spool feeds an elongated conductor or conductor 16, 18 through a rotating frame or carriage 20 to a twisting location being a twist stop device 28 and then onto a strand puller or take-up spool 30. It is one feature of the present invention to independently adjust the rate of rotation of the rotating frame 20 from the rate of rotation of the strand puller 30 in order to deterministically vary the number of twists per inch on the resulting cable.

As shown in FIG. 1, the apparatus 10 generally comprises a pair of strand spools 12, 14 where each feeds a single conductor 16, 18 through the rotating frame 20 driven by a twist drive motor 22. Although the present embodiment discloses an apparatus with the rotating frame 20 and the fixed twist stop device 28, other arrangements are clearly within the scope of the invention for making the end product of the variable twist rate twisted pair ("VTRTP") cable. Further, additional strand spools could be added to create a multi-conductor twisted cable. The twist stop or die 28 receives the pair of rotating conductors from the rotating frame 20 and outputs a single twisted pair cable 26. A strand puller 30 coils the twisted pair cable 26 thereon. A controller 24 directs the rotation of the rotating frame 20 and the strand puller 30 in a predetermined manner so that a variable twist is placed on the cable over different segments.

Further, a multi-pair cable (not shown) can be manufactured by placing appropriate spools on the apparatus and further controlling the twisting of the already twisted pair cables as they are joined into one cable. An appropriate twist stop for each of the pairs (not shown) is required for handling multi-pair cables. The outer jacket and/or shielding is applied to the multi-pair cable in a conventional manner and is not shown.

Still referring to FIG. 1, the pair of strand spools 12, 14 each have the single conductor 16, 18 coiled thereon. Typically, the conductors 16, 18 are coated with an insulating material which is conventional in the art. As the conductors 16, 18 are fed off of the strand spools 12, 14, a device may be attached to the spools 12, 14 being either mechanical or electro-mechanical to monitor the amount of conductor removed. This device may be a rotation counter 76 installed on each spool to provide rotation information to a computer, for example, for monitoring the length of conductor on a particular segment. In another embodiment, the conductor 16, 18 itself may pass through a device (not shown) for measuring the length of conductor removed. A larger capacity of the strand spools provides for lower costs since the spools would not have to be changed as often. The strand spools 12, 14 are mounted on the rotating frame 20 that is driven by a carriage twisting drive motor 22 by means of conventional gears, for example. The twisting drive motor 22 is attached to the fixed frame 86 upon which the rotating frame 20 is attached.

Figure 5:
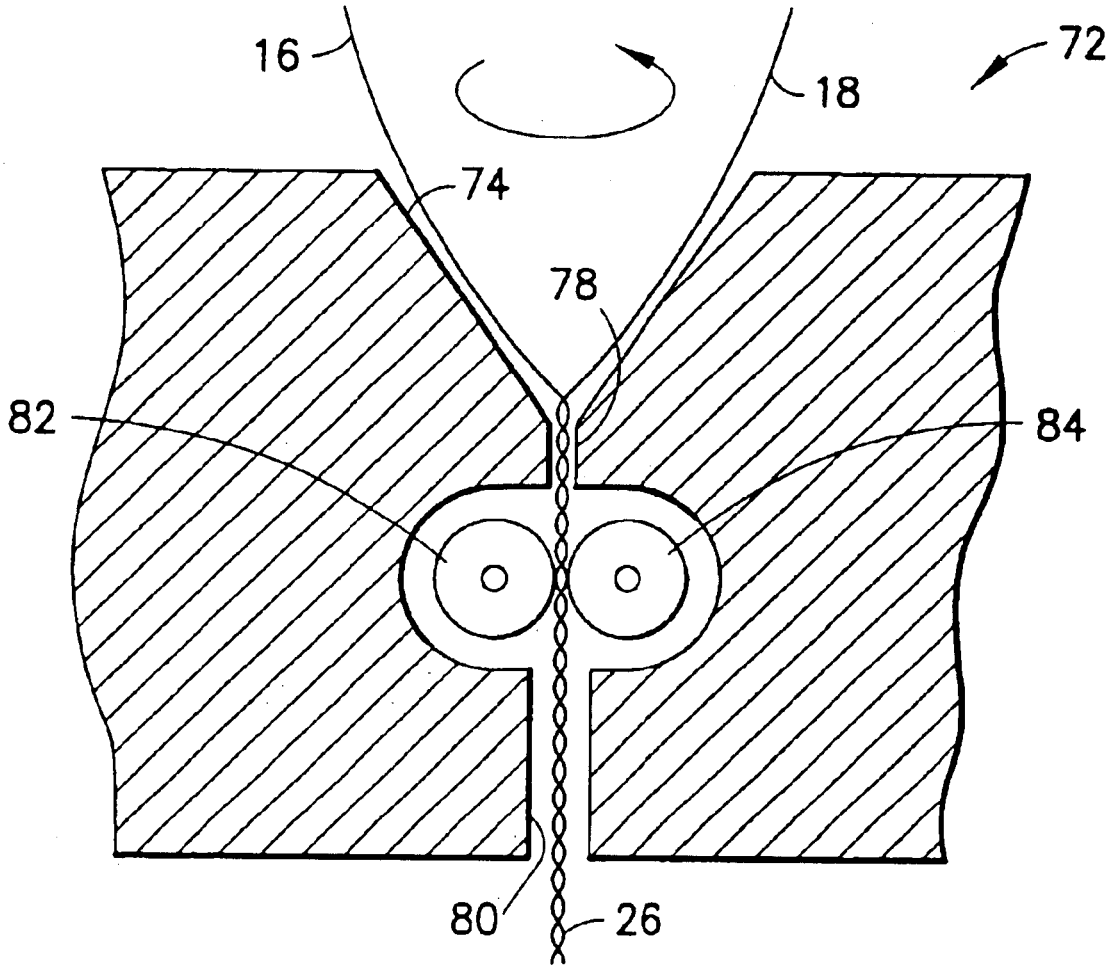
FIG. 5 is a cross-sectional view of one embodiment of a twist stop incorporating features of the present invention.

One embodiment of a twist stop device 72 is disclosed in FIG. 5. The purpose of the twist stop device 72 is to stop the rotation of the resulting cable, at the twisting location, which is formed by the rotating conductors from the rotating frame 20. A pair of conductor guides 92, 94 in the rotating frame 20 shown in FIG. 1 insure that the twisting action takes place at the twist stop device 72. The pair of conductors 16, 18 are shown being twisted by the rotating frame 20 of FIG. 1 and entering into a funnel shaped cavity 74 in FIG. 5 which guides the twisting conductors through an exit 78 of this cavity 74 and into a vertical channel 80. Inside the channel 80 is located, for example, a pair of pinch rollers 82, 84 having, for example, rubbery coated surfaces (not shown) that grip the twisted cable 26 therein and prevent the cable 26 from further rotation after the twist is placed thereon. The strand puller advances the cable 26 from the channel 80 at a predetermined rate that may be measured as so many inches per second. This rate being provided by the controller 24 to the strand puller drive motor 32 of FIG. 1.

Still referring to FIG. 1, the controller 24 is connected to the twisting drive motor 22 of the rotating frame 20 to set the rotation rate of the rotating frame 20 by providing appropriate signals thereto. The higher the rate of rotation of the rotating frame 20, the more twists per inch are placed on the twisted pair cable 26, normally. This clearly depends on the rate of take-up of the strand puller 30. The twisted pair cable strand puller 30 receives and coils the twisted pair cable 26 thereon and is driven by the puller drive motor 32 connected also to the controller 24. The controller 24 provides appropriate signals to both the twisting drive motor 22 of the rotating frame 20 and the puller drive motor 32 of the strand puller. Preferably, the controller 24 includes a programmable computer having information stored therein which is used to control both the drive motors 22, 432 according to a desired end product, i.e., the twisted pair cable having a defined twist rate thereon at each point. The type of information stored therein is further disclosed below.

In addition, the controller 24 which selectively controls both the twisting drive motor 22 and the puller drive motor 32 is further able to determine the amount of conductor per unit length as noted above, whether 2 feet or 10 feet, based on the amount of conductor removed from the strand spools 12, 14.

Depending on the predetermined rates, a variety of twist patterns may be imparted to the cable 26. A first predetermined rate being defined as the rate of rotation of the rotating frame 20, and, the second predetermined rate being defined as the puller rate of the strand puller 30. For example, the rotating frame 20 may have a range of rotation rates as measured by turns per second, for example, a slow rate to a fast rate, and so if the frame 20 is turning fast, more twists per inch are normally put on the cable 26 if the puller drive rate is not changed. But if the cable puller drive motor 32 is pulling the cable 26 faster, a different twist rate may occur at that time. The strand puller rate of the take-up spool having a range of rates, a slow rate to a fast rate where the rate may be measured as inches per second. If the cable puller drive motor 32 is pulling fast, relative to its range of rates, and the twisting drive motor is turning slow, relative to its range of rates, the twist rate will be very low. If the cable puller drive motor 32 is pulling very slowly and the twisting drive motor is turning very fast, a higher twist rate will be produced. By the proper selection of the motor speeds, the twist rate on the resulting cable 26 may be made to change to almost any value within the limitations of the apparatus.

Figure 2:
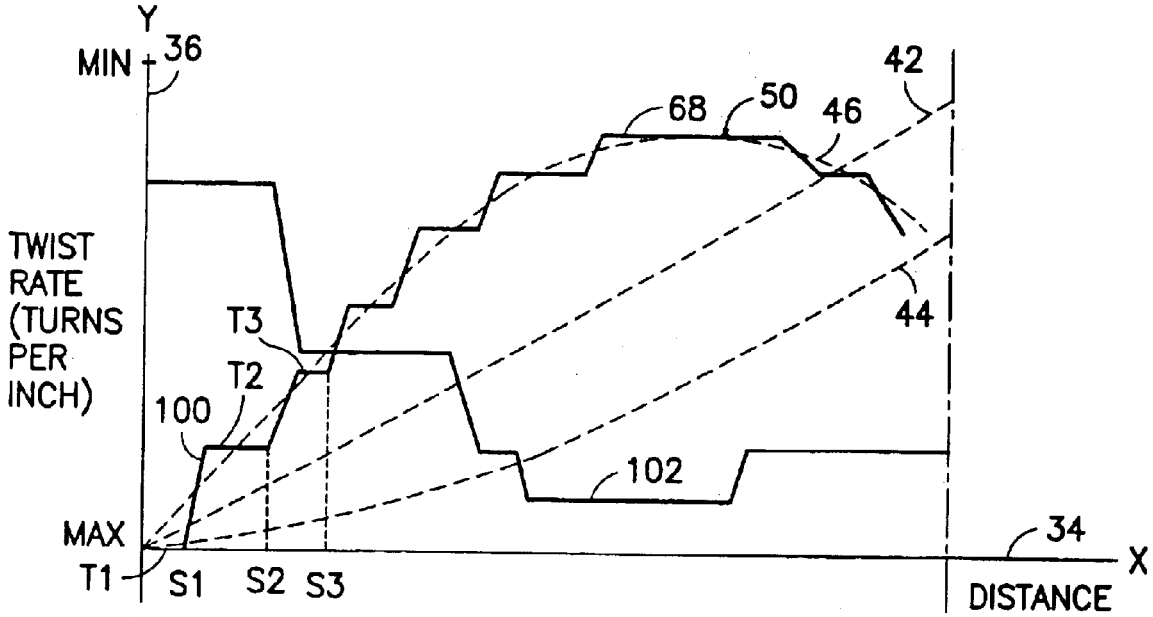
FIG. 2 is a graph representing different types of variable twist rates on different segments.

FIG. 2 is a generalized graph of different twist rate algorithms. The horizontal axis 34, the x-axis, represents the distance from the starting point of a cable 60, shown in FIG. 4, for example. The cable 60 may have numerous segments over its length starting with segments S1, S2 and S3. The vertical axis 36, the y-axis, represents the twist rate in the cable in "turns per inch," the higher twist rate located near the origin. The dashed curves on the graph represent average twist rates at a given point in a cable length. The line 42 which may be a mathematical formula, for example, represents a linear change in the twist rate over the length of the cable. The line 44 represents an increasing twist rate from the start to the end of the cable, and line 46 represents the twist rate increasing to a given point 50 and then decreasing such as would be provided by the first section of a sine curve. It is clear that many other algorithms may be selected to change the twist rate on the cable as it is being manufactured by the present invention and even one not represented by a mathematical formula is allowed.

Still referring to FIG. 2, the cable 26, only partially shown in FIG. 5 as cable 78, has a twist rate of T1 over segment 51, a twist rate of T2 over segment S2, and a twist rate of T3 over a segment S3. The twist rates are decreasing over each segment. It is further seen that the machine 10 is not able to instantaneously change the twist rate from segment to segment and thus a step segment 100 being a continuously changing twist rate will exist between segments S1 and S2. The cable 26 of FIG. 1 is thus a combination of segments having, alternating, fixed twist rates and continuously changing twist rates segments. The length of each lengthwise segment being programmed into the controller 24 as well as other parameters necessary to generate the cable 26 of FIG. 1. A graphical illustration, cable 102 in FIG. 2 is illustrated having increasing twist rates over several segments and a decreasing twist rate at the end. Because of the physical limitation of twisting elongated conductors and the controller being able to change twist rates and segment lengths, a cable may appear to have a continuously changing twist rate where, for example, the segments are very short, on the order of inches to feet, and the twist rate is changed only slightly from one segment to another.

Figure 3:
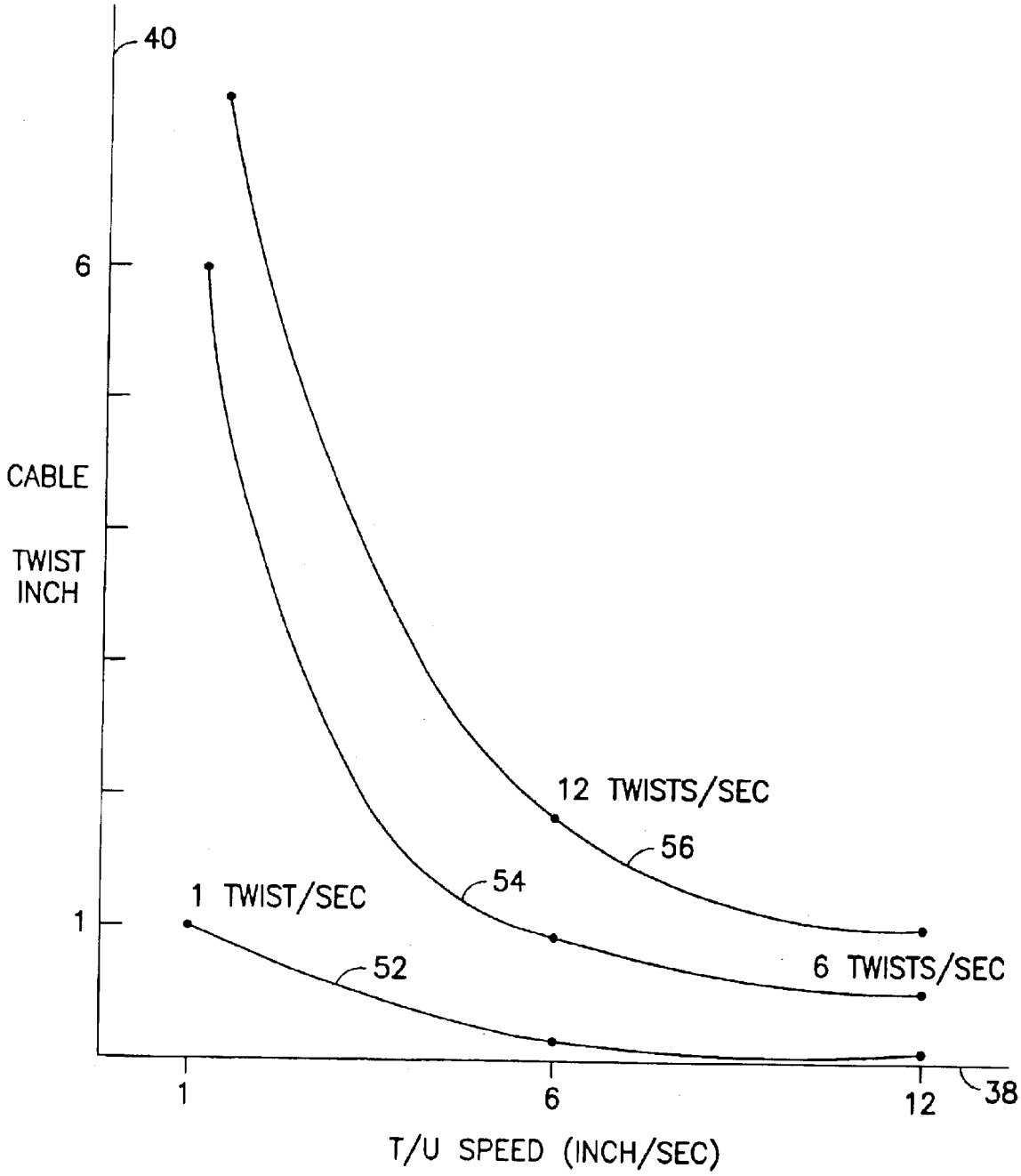
FIG. 3 is a graph representing the twist rate of a cable as controlled by other factors of the present invention.

To further understand the operation of the variable twist rate apparatus 10, reference is made to FIG. 3 which represents by graph how the twisting drive motor 22 which turns the rotating frame 20 at a first predetermined rate, twists per second, each twist representing one rotation of the frame 20, relates to the strand puller rate, inches per second, for example, of the puller drive motor 32. As seen in FIG. 3, the horizontal axis 38 represents the take-up rate and is divided into units of inches per second. The vertical axis 40 represents the actual twist rate, twists per inch, on a cable at a particular distance obtained from FIG. 1. The lines represented thereon reflect different rotation rates of the frame 20. For example, line 52 represents a rotation rate of one twist per second of the frame 20 with a changing take-up speed reflected. Although, line 54 is limited as to the twist rate, the computer directing the controller 24 of FIG. 1 may be programmed to jump to different lines and follow different algorithms such as shown in FIG. 2. Line 54 represents a twist rate of 6 twists per second and line 56 represents 12 twists per second. These numbers only being illustrative for the purpose of explaining the present invention.

Thus, one is able to select an instantaneous twist rate from FIG. 2 according to the line selected. This twist rate is then found on the vertical axis 40 of FIG. 3 and from there one is able to obtain the settings for the rotating frame 20, the desired twist rate per second, and the speed of the strand puller 30 in inches per second. Thus a cable having 4 twists per inch may be generated by having a twisting drive rate of 6 twists per second and a strand puller rate of 1.5 inches per second (4 twists per inch =6 twists per second/1.5 inches per second).

Figure 4:
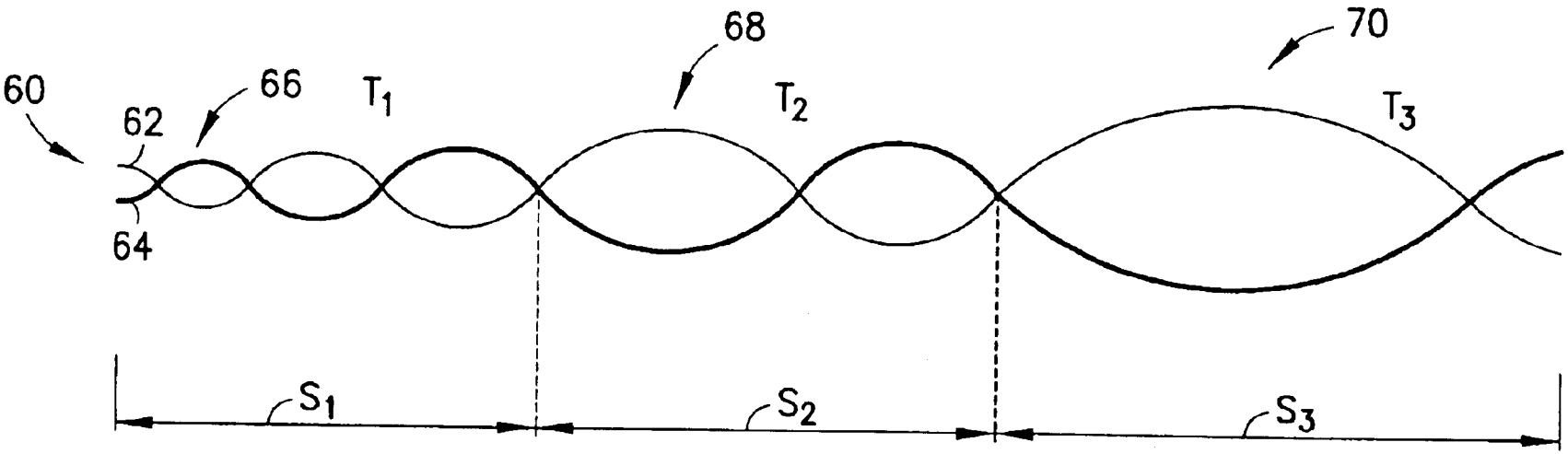
FIG. 4 is a representation of a twisted pair of conductors having a multiple twist rates over segments of cable in accordance with present invention.

FIG. 4 illustrates a pair of twisted conductors 62, 64 formed in accordance with the present invention. Over a segment having a predetermined distance, the twist rate of the pair of conductors 62, 64 changes from a relatively high twist rate at point 66 (segment S1 with a twist rate of T1), to a relatively medium twist rate at point 65 (segment S2 with a twist rate of T2) and to a relatively low twist rate at point 70 (segment S3 with a twist rate of T3).

The twisted pair cable thus generated by the apparatus 10 may have different twist rates over segments of unequal distance, and thus if two of the twisted pair cables are bundled, no point in adjacent cables would have similar twist rates thus insuring a minimum of crosstalk in either a twisted pair cable or in a cable having multi-twisted pairs.

The present invention is thus directed at obtaining high quality twisted pair cables, for example, for handling data rates ranging from 1 Mbps to 100 Gbps.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An apparatus for forming a twisted pair cable, the apparatus comprising:

a device for rotating at a first predetermined rate of rotation a pair of elongated conductor strands about a twisting location, the device guiding the elongated conductor strands to the twisting location;

a twist stop device mounted at the twisting location and effective to grip running lengths of elongated conductor strands passing through device for rotating and the twisting location; and a strand puller for engaging the running lengths of elongated conductor strands, the strand puller advancing the strands passing through the device for rotating, and the twist stop device, the strand puller operating at a second predetermined rate of rotation; wherein the device for rotation and the strand puller operate independently to make the twisted pair cable, the twisted pair cable having different twist rates on different segments, the segments having different lengths.

2. An apparatus in accordance with claim 1 wherein the first predetermined rate is provided by a controller for controlling a rate of rotation of the twisting drive.

3. An apparatus in accordance with claim 1 wherein the second predetermined rate is provided by a controller for controlling a rate of rotation of the strand puller drive.

4. An apparatus in accordance with claim 1 wherein a controller comprises a computer programmed to control the twisting drive and the puller drive as determined by algorithms stored in the computer to produce the twisted pair cable having a predetermined twist rate over segment lengths, to change the predetermined twist rate and to change the segments lengths wherein adjacent twisted pair cables have different twist rates at adjacent locations.

5. An apparatus in accordance with claim 1 wherein the twist stop device converts a rotating cable of a twisted pair from the twisting location to a non-rotating cable for take-up on the strand puller.

6. An apparatus for forming a variable pitch twisted pair cable comprising:

a rotating frame operatively associated with a stationary frame, the rotating frame revolving about with a twisting location, the rotating frame including conductor guides for directing running lengths of elongated conductor strands along predetermined paths to the twisting location;

a twisting drive operatively connected to the rotating frame and driving the rotating frame in revolutions about the twisting location; and a puller drive operatively connected to a strand puller and driving the strand puller to advance strands through the conductor guides, the twisting location, the twist stop device, and the strand puller, and wherein the twisting drive and the puller drive are adapted to operate at varying speeds relative to each other to generate twisted pairs of strands passing through the apparatus into a twisted pair cable, the twisted pair cable having adjacent lengthwise segments with segment lengths that differ one from the other, and wherein a number of twists of one segment length differ from a number of twists of another segment length.

7. A method of forming a variable twist rate twisted pair cable, the method comprising the steps of:

rotating a frame on which two conductor strand spools are mounted at a first predetermined rate to create a twisting relationship between two conductors being fed from each strand spool and through the frame;

feeding the two conductors through a twist stop device that fixes a relative placement of each conductor as the conductors are twisted together from the rotating carriage and through the twist stop;

rotating a strand puller at a second predetermined rate to pull the two conductors from the rotating carriage and through the twist stop and to collect the variable twist rate twisted pair cable formed; and wherein the first predetermined rate is independent from the second predetermined rate in order to vary the number of twists per foot over different segment lengths of the cable.

8. A method in accordance with claim 7 wherein the first and second predetermined rates are provided by a controller.

9. A method in accordance with claim 8 wherein the controller comprises a programmed computer having algorithms therein which determine the twist rate of the twisted pair cable, the twist rate being variable from one lengthwise segment of the cable to another lengthwise segment of the cable and wherein the length of each lengthwise segment is different.

* * * * *